US009334021B1

(12) United States Patent
Fielding

(10) Patent No.: US 9,334,021 B1
(45) Date of Patent: May 10, 2016

(54) PONTOON BOAT HAVING EXTENDABLE UNDERWATER PLATFORM

(71) Applicant: Jesse J. Fielding, Braidwood, IL (US)

(72) Inventor: Jesse J. Fielding, Braidwood, IL (US)

( * ) Notice: Subject to any disclaimer, the term of this patent is extended or adjusted under 35 U.S.C. 154(b) by 0 days.

(21) Appl. No.: 14/604,673

(22) Filed: Jan. 24, 2015

(51) Int. Cl.
*B63B 1/10* (2006.01)
*B63B 1/14* (2006.01)
*B63B 35/73* (2006.01)
*B63B 1/12* (2006.01)

(52) U.S. Cl.
CPC ..... *B63B 1/107* (2013.01); *B63B 1/125* (2013.01); *B63B 1/14* (2013.01); *B63B 35/73* (2013.01); *B63B 2001/145* (2013.01)

(58) Field of Classification Search
CPC ..... B63B 1/107
USPC ..... 114/61.12
See application file for complete search history.

(56) References Cited

U.S. PATENT DOCUMENTS 3,653,354 A * 4/1972 Pangalila ..... B63B 35/4413 114/125
4,085,473 A * 4/1978 Franklin ..... B63B 29/00 114/188
4,312,287 A * 1/1982 Kuo ..... B63B 27/02 114/259
5,085,164 A * 2/1992 Whitton ..... B63B 27/14 114/362
5,136,963 A * 8/1992 Zuzik ..... B63B 29/10 114/343
6,298,801 B1 * 10/2001 May ..... B63B 3/48 114/364
6,868,799 B2 * 3/2005 Wright ..... B63B 27/143 114/343
7,194,972 B2 * 3/2007 Schmitz, Sr. ..... B63B 1/10 114/61.1
7,946,243 B1 * 5/2011 Ulrich ..... B63B 27/16 114/362
8,056,496 B1 * 11/2011 Bussa ..... B63B 27/146 114/362
8,375,880 B1 * 2/2013 St. Clair, Jr. ..... B63B 27/14 114/362
2014/0165893 A1 * 6/2014 O'Neal ..... B63B 1/14 114/61.15

* cited by examiner

*Primary Examiner* — Lars A Olson
*Assistant Examiner* — Jovon Hayes
(74) *Attorney, Agent, or Firm* — McDonnell Boehnen Hulbert & Berghoff LLP.

(57) ABSTRACT

A multi-hull vessel including a main deck, a first hull and a second hull positioned beneath the main deck, a secondary deck, wherein the secondary deck is extendable from a first stowed position beneath a main deck of the vessel between the first hull and the second hull to a second extended position in front of the vessel, and wherein the secondary deck is further movable to a third submerged position where the secondary deck provides an underwater platform.

30 Claims, 7 Drawing Sheets

PONTOON BOAT HAVING EXTENDABLE UNDERWATER PLATFORM

BACKGROUND

The present application generally relates to multi-hull vessels, such as pontoon boats. More particularly, the present application relates to a multi-hull vessel having an extendable secondary deck. The extendable secondary deck is extendable from a first stowed position beneath a main deck of the vessel to a second extended position in front of the vessel, and further movable to a third submerged position where the secondary deck provides an underwater platform.

Recreational boaters often use pontoon boats on lakes and rivers to enjoy time out on the water. During periods of hot weather, it is common for passengers to jump in the water to swim and cool off. However, swimming in the middle of a lake or river may be dangerous as currents or wind could separate swimmers from the vessel. As a result, it is common for a pontoon boat to anchor near a shore or beach so that the passengers can stand in the water to the cool off near shore. However, sometimes there is a limited area around the shore or beach to anchor, and when a spot is found there may be a lack of privacy due to the closer proximity to other boaters that have anchored near the same shore or beach. Furthermore, when anchored near shore, young children or pets may leave the water and wander away from the vicinity, also allowing for the possibility of a child or pet becoming separated from the vessel.

In the past, efforts have been made to provide an extended deck on a pontoon boat to provide for more room for passengers, or to provide a ramp for entering and/or exiting the vessel, involving the use of floating decks or platforms. For example, U.S. Patent Publication US2014/0165893 entitled "Extendable Multihull Boat" includes an extendable floating deck positioned on top of an additional pair of pontoons.

SUMMARY

In one aspect, a multi-hull vessel is provided including a main deck, a first hull and a second hull positioned beneath the main deck, a secondary deck, wherein the secondary deck is extendable from a first stowed position beneath a main deck of the vessel between the first hull and the second hull to a second extended position in front of the vessel, and wherein the secondary deck is further movable to a third submerged position where the secondary deck provides an underwater platform.

In a further aspect, a pontoon boat is provided including a main deck, a first pontoon and a second pontoon positioned beneath the main deck, an upper frame attached to a bottom of the main deck between the first pontoon and the second pontoon, a lower frame connected to the upper frame and positioned below the upper frame, a secondary deck movably engaged with the lower frame, wherein the secondary deck is extendable from a first stowed position beneath the main deck of the vessel to a second extended position in front of the vessel, and wherein the secondary deck is further movable to a third submerged position where the secondary deck provides an underwater platform.

In another aspect, a method of providing an underwater platform on a multi-hull vessel is disclosed comprising the steps of: (1) providing vessel having a main deck, a first hull and a second hull positioned beneath the main deck, an upper frame positioned beneath the main deck, a lower frame attached to the upper frame, a secondary deck movably mounted to the lower frame in a first stowed position beneath the main deck of the vessel between the first hull and the second hull, (2) extending the secondary deck from the first stowed position into a second extended position in front of the main deck, and (3) lowering the secondary deck into a third submerged position under the water to provide an underwater platform.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

The present embodiments are directed to multi-hull vessel having a main deck and a secondary deck that may be positioned in a first stowed position beneath the main deck, and extended to a second extended position in front of the vessel. The secondary deck may also be advantageously lowered under the water to a third submerged position where the second deck may serve as an underwater platform. The underwater platform created by the secondary deck may be placed at a variable depth. For example, the secondary deck may be submerged just several inches or so under the water where passengers may sit on a lawn chair and dangle their feet in the water on a hot day. Alternately, the secondary deck may be submerged several feet to allow passengers to stand on the underwater platform to cool off. With such an underwater platform, it is unnecessary for the vessel to anchor near a shore or beach to allow people to stand in the water near the shore. With this configuration the secondary deck serves as an artificial island or sand bar in the water. When in the middle of the lake or river, the passengers can advantageously stand on the platform instead of floating around in life jackets. A fence or netting may be placed around the underwater platform to prevent passengers or pets from being separated from the vessel.

Furthermore, the secondary deck may be further submerged to 4-5 feet deep to provide a swimming area in front of the vessel. The swimming area may be fenced or roped in to provide a safe area for children and pets to swim without having to worry about current or wind separating them from the vessel while they swim.

Figure 1:
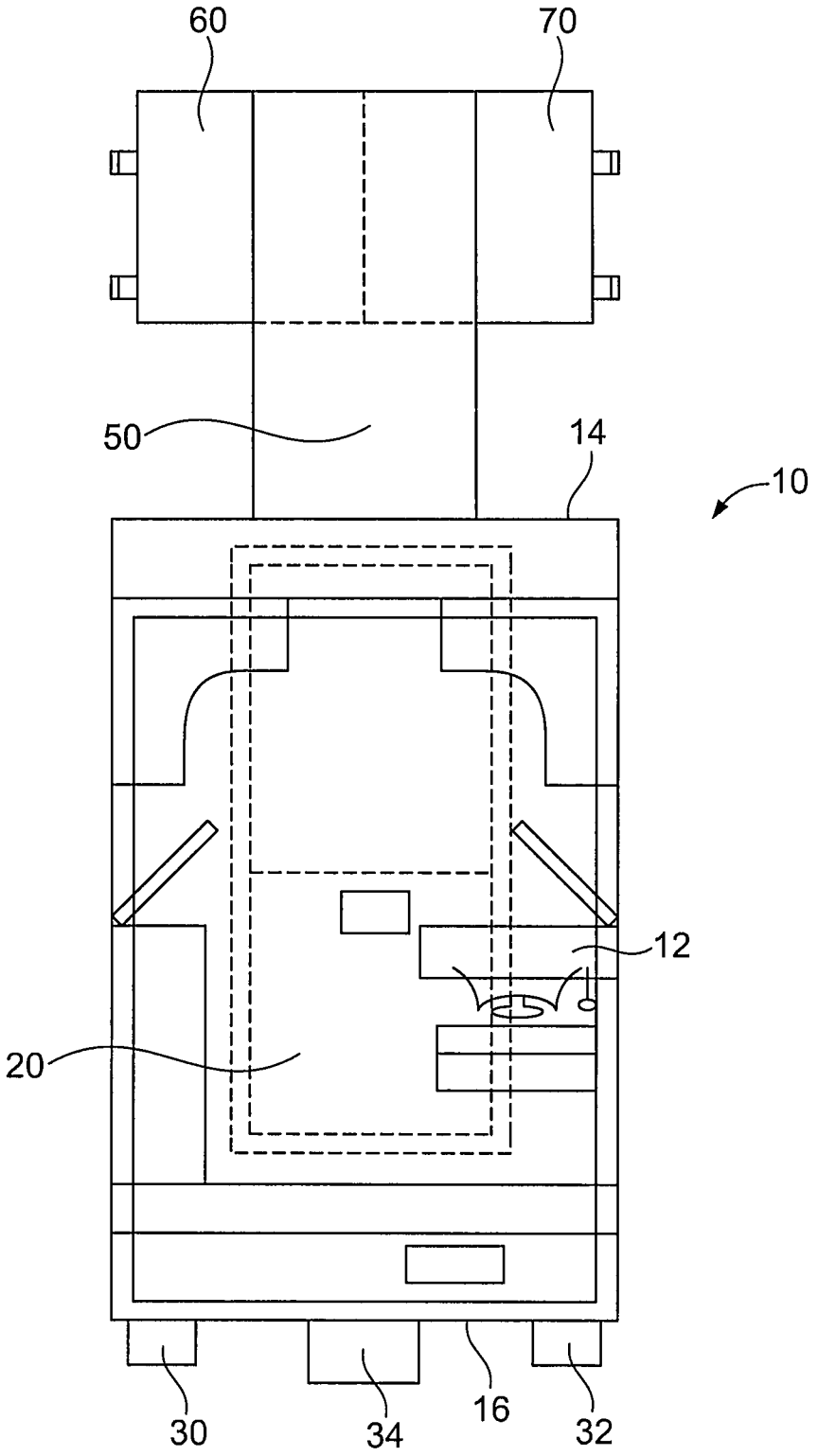
FIG. 1 is a top view of pontoon boat 10, according to an example embodiment.

FIG. 1 is a top view of pontoon boat 10, having a steering control 12 and main deck 20, and motor 34 extending from the stern 34 of the pontoon boat 10. Pontoon boat 10 includes pontoon hulls 30 and 32. A secondary deck 50 is shown extending from the bow 14 of pontoon boat 10, and is shown with deck extending members 60 and 70 folded out to extend the size of the secondary deck 50, according to an example embodiment. It will be appreciated that in FIGS. 1-8*d*, the deck extending member 50 is shown extending from a pontoon boat. The use of a pontoon boat is illustrative and secondary deck 50 may be implemented on other multi-hull vessels such as a tri-hull pontoon boat (or tri-toon), catamaran, or trimaran.

Figure 2:
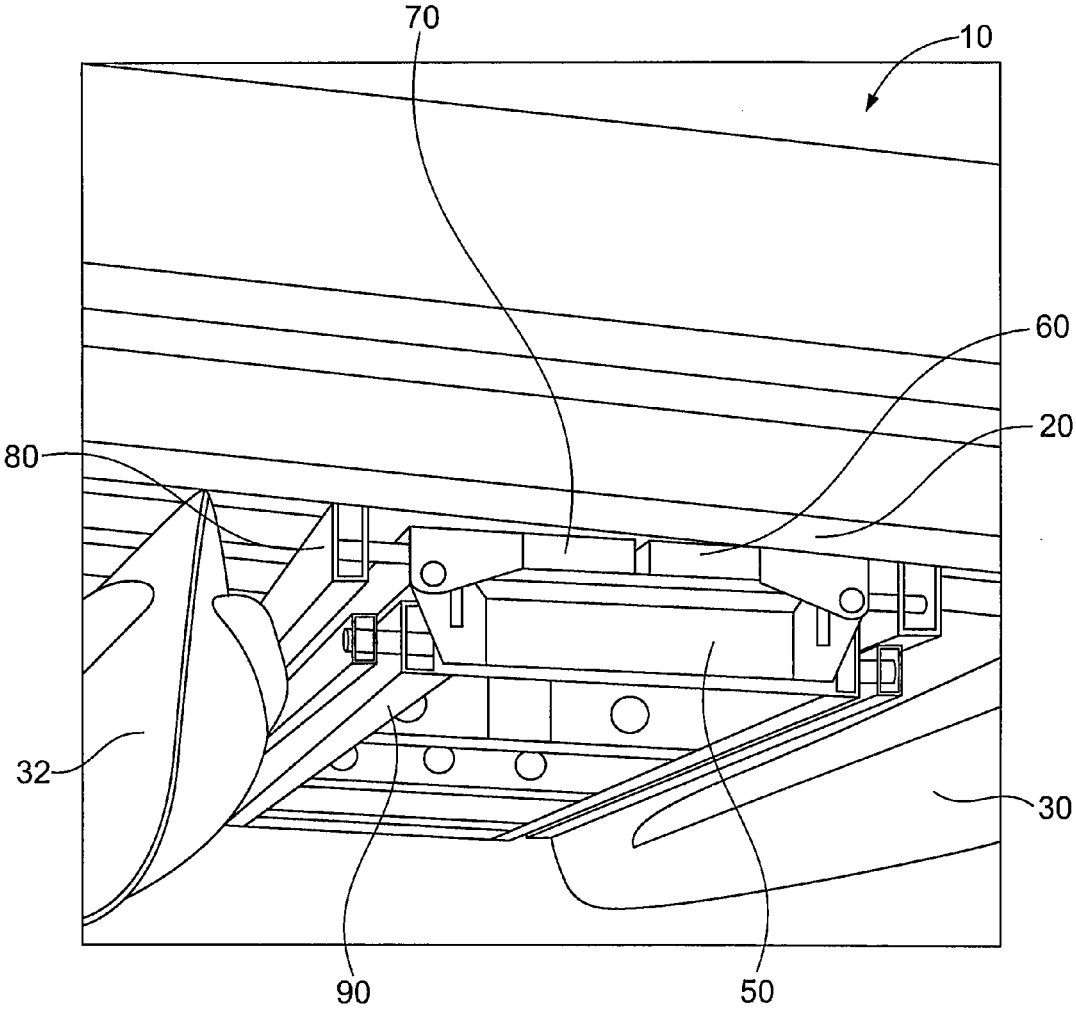
FIG. 2 is a perspective view from the underneath and from in front of pontoon boat 10 shown in FIG. 1, with secondary deck 50 in a stowed position, according to an example embodiment.

FIG. 2 is a perspective view from the underneath and from in front of pontoon boat 10 shown in FIG. 1, with secondary deck 50 in a stowed position beneath main deck 20 and between pontoons 30 and 32. Secondary deck 50 is shown positioned beneath an upper frame 80 secured to the bottom of main deck 20 and within a lower frame 90 that is attached to the upper frame.

Figure 3:
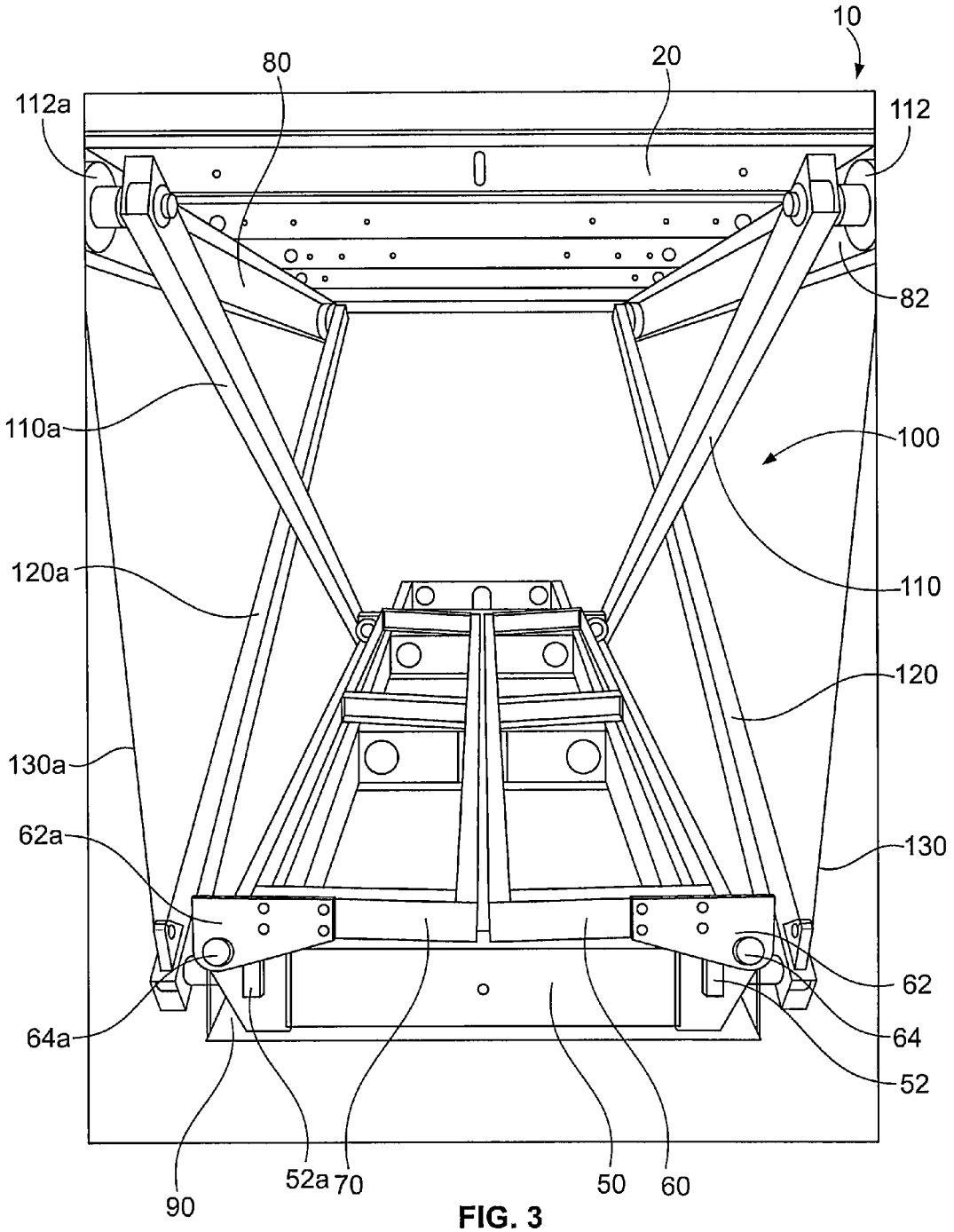
FIG. 3 is a perspective view from the underneath and from in front of pontoon boat 10 shown in FIG. 2, with secondary deck 50 in a lowered position beneath main deck 20.

FIG. 3 is a perspective view from the underneath and from in front of pontoon boat 10 shown in FIG. 2, with secondary deck 50 in a lowered position beneath main deck 20. Deck extending members 60 and 70 remain in the folded position over secondary deck 50. Once secondary deck 50 is extended in front of pontoon boat 10, then deck extending member 60 may be unfolded to increase the size of secondary deck 50 by rotating about rod 64. A flange 62 is positioned on the front end of deck extending member 60 and a stop 52 is positioned on a front end of secondary deck 50. When deck extending member 60 is unfolded, flange 62 engages stop 52 to prevent further rotation of the deck extending member 60 and to position a top surface of the deck extending member 60 in the same plane as the top surface of the deck extending member 50.

Similarly, once secondary deck 50 is extended in front of pontoon boat 10, then deck extending member 70 may also be unfolded to increase the size of secondary deck 50 by rotating about rod 64*a*. A flange 62*a* is positioned on the front end of deck extending member 70 and a stop 52*a* is positioned on a front end of secondary deck 50. When deck extending member 70 is unfolded, flange 62*a* engages stop 52*a* to prevent further rotation of the deck extending member 70 and to position a top surface of the deck extending member 70 in the same plane as the top surface of the deck extending member 50.

In FIG. 3, secondary deck 50 remains in a retracted position within lower frame 90. A scissors mechanism 100 has been used to lower the lower frame 90 from upper frame 80, to move secondary deck 50 into a submerged position. The scissors mechanism includes a first arm 110 and a second arm 120. The first arm 110 has a top end fixedly attached to upper frame rail 82 at point 112, and a lower end in rolling engagement with lower frame 90. As the lower frame 90 is lowered by cable 130, the lower end of the first arm 110 moves in a forward direction. Similarly, the second arm 120 has a lower end fixed to lower frame 90 and an upper end in rolling engagement with upper frame rail 82. As the lower frame 90 is lowered by cable 130, the upper end of the second arm 120 moves in a forward direction.

The same scissors mechanism is positioned on the opposite side of secondary deck 50 as well. In particular, the scissors mechanism on the opposite side includes a first arm 110*a* and a second arm 120*a*. The first arm 110*a* has a top end fixedly attached to upper frame rail 80 at point 112*a*, and a lower end in rolling engagement with lower frame 90. As the lower frame 90 is lowered by cable 130*a*, the lower end of the first arm 110*a* moves in a forward direction. Similarly, the second arm 120*a* has a lower end fixed to lower frame 90 and an upper end in rolling engagement with upper frame rail 80. As the lower frame 90 is lowered by cable 130*a*, the upper end of the second arm 120*a* moves in a forward direction.

Cables 130 and 130*a* may operate to lower and raise the lower frame 90 and secondary deck 50. Cables 130 and 130*a* may be operated by hand, for example by using a hand crank. Alternately, cables 130 and 130*a* may be operated using a motor, such as an electric winch. A pair of electric winches may be used, one on each side of the secondary deck 50.

Figure 4:
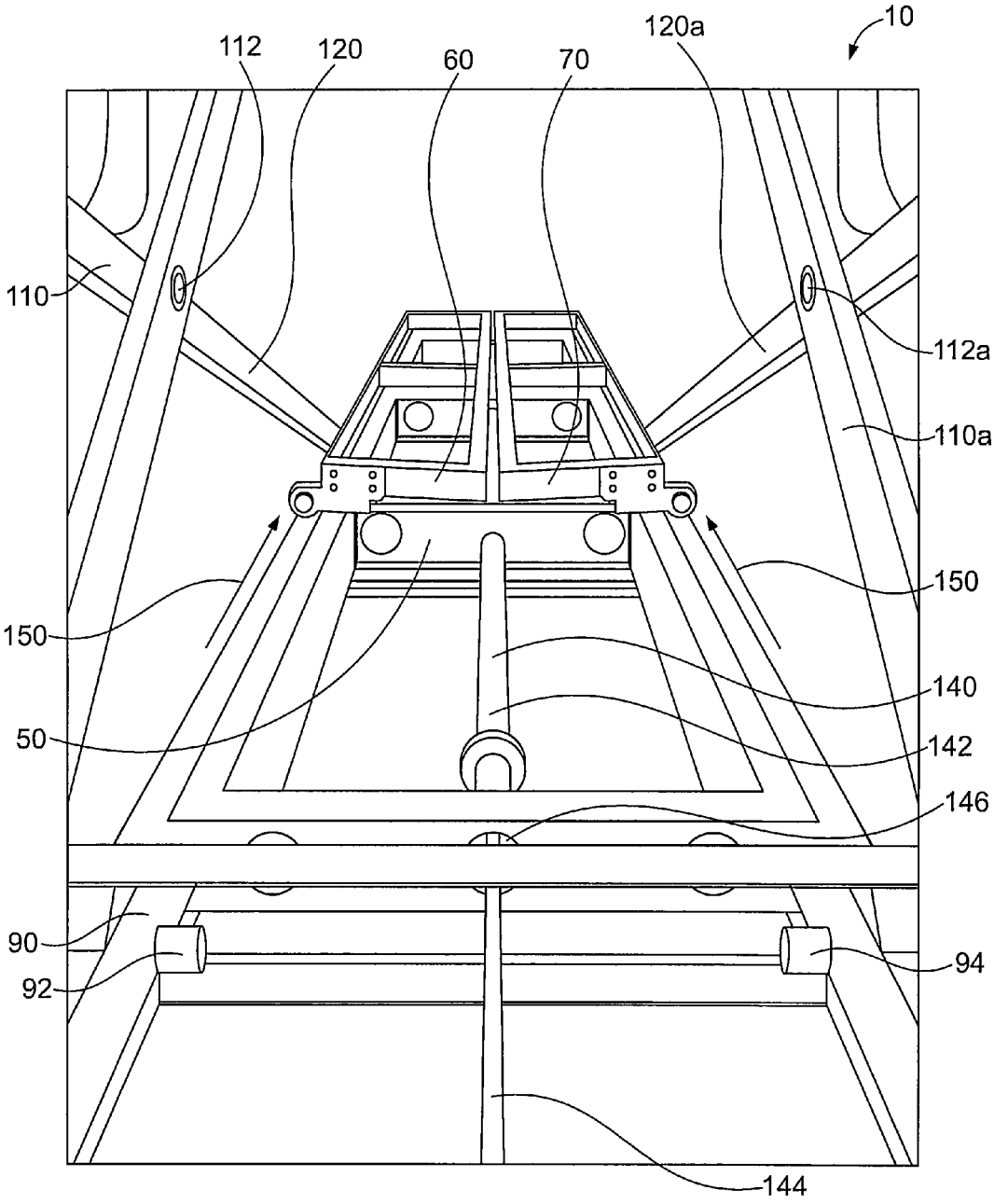
FIG. 4 is a perspective view from the underneath and looking towards the front of pontoon boat 10 shown in FIG. 3, with the secondary deck 50 being moved towards an extended position.

FIG. 4 is a perspective view from the underneath and looking towards the front of pontoon boat 10 shown in FIG. 3, with the secondary deck 50 being moved towards an extended position as indicated by arrows 150. In FIG. 4, the first arm 110 and second arm 120 of the scissors mechanism are shown rotatably attached at the midpoint 112 of the arms. Similarly, first arm 110*a* and 120*a* of the scissors mechanism are shown rotatably attached at midpoint 112*a* of the arms. The deck extending members 60 and 70 remain in a folded position on top of secondary deck 50. In other embodiments, the deck extending members 60 and 70 may be folded beneath the secondary deck 50 and rotated upwardly where they could be locked into position. Secondary deck 50 glides along rollers 94 and 92 on lower frame 90 as the secondary deck is extended. In this regard, the secondary deck is shown being moved outwardly using cylinder 140 having a cylinder tube 142 and piston rod 144. The cylinder could be operated pneumatically or hydraulically. The piston rod is shown extending through a hole 146 in the lower frame 90. Furthermore, other means for extending the secondary deck 50 could also be used including a rack and pinion assembly or an assembly of gears positioned on the lower frame 90 and secondary frame 50.

A pneumatically operated cylinder is preferred. The onboard compressed air used to extend and retract the cylinder may also be used for other purposes. In particular, the secondary deck 50 and deck extending members 60 and 70 are shown in the Figures with the flooring removed to illustrate the structure of those members. It will be appreciated that raising the secondary deck 50 from a submerged position will require significant force to pull the secondary deck 50 and flooring up through the water, like lifting a barn door up through the water. Accordingly, the secondary deck 50 and/or lower frame 90 may advantageously be provided with tubes or tanks that may be filled with water while the secondary deck 50 is lowered, but which may be purged and filled with compressed air while the secondary deck 50 is being raised to provide a buoyant upward force to lessen the force required to raise the secondary deck 50 from a submerged position.

Figure 5:
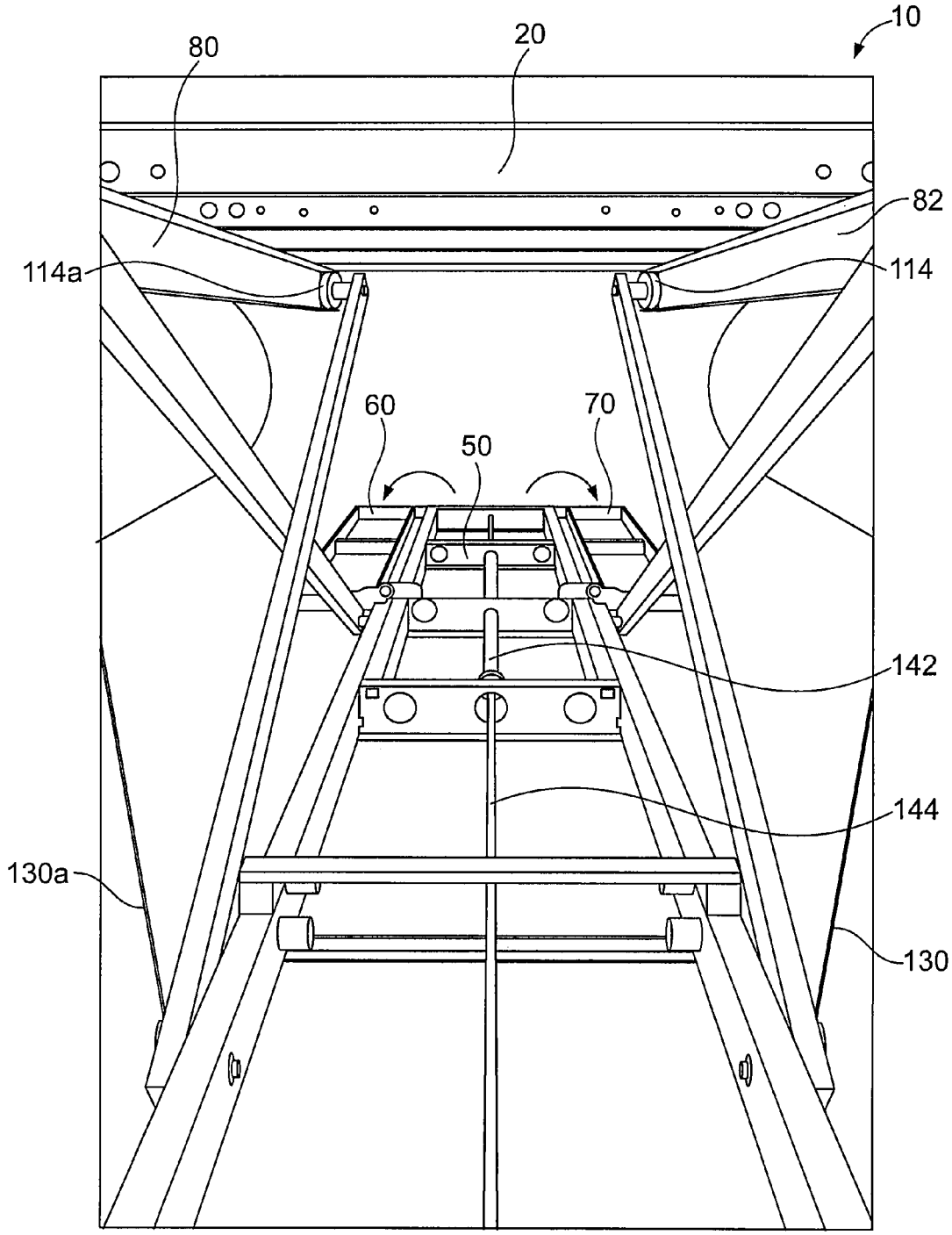
FIG. 5 is a perspective view from the underneath and towards the front pontoon boat 10 shown in FIG. 4, with secondary deck 50 moved into an extended position, and with deck extending members 60 and 70 unfolded to extend the size of secondary deck 50.

FIG. 5 is a perspective view from the underneath and towards the front pontoon boat 10 shown in FIG. 4, with secondary deck 50 moved into an extended position, and with deck extending members 60 and 70 unfolded to increase the size of secondary deck 50. In this configuration, lower frame 90 is suspended by cables 130 and 130*a*, where rollers 114 and 114*a* have moved within upper frame 80 and 82 to lower the lower frame 90 and secondary deck 50 into a submerged position with the secondary deck 50 and deck extending members 60 and 70 positioned in front of pontoon boat 10 and main deck 20.

Figure 6:
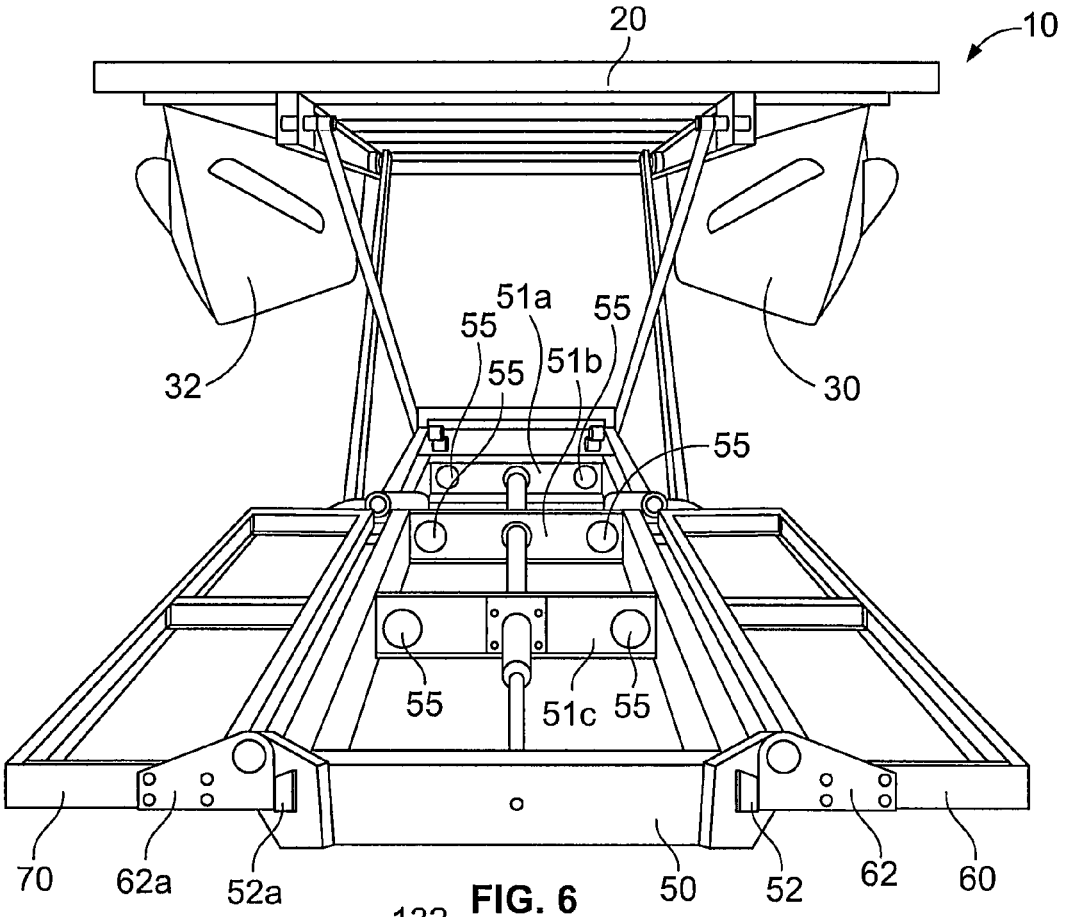
FIG. 6 is a perspective view from the underneath and from the front of pontoon boat 10 shown in FIG. 5, showing secondary deck 50 in an extended position with deck extending members 60 and 70 unfolded to extend the size of secondary deck 50.

FIG. 6 is a perspective view from the underneath and from the front of pontoon boat 10 shown in FIG. 5, showing secondary deck 50 in an extended position with deck extending members 60 and 70 unfolded to increase the size of secondary deck 50. The secondary deck 50 is shown in a submerged position in front of main deck 20, with deck extending members 60 and 70 in front of pontoons 30 and 32. With deck extending member 60 in an unfolded position, an inner edge of flange 62 engages stop 52 to prevent further rotation of deck extending member so that the upper surface of the deck extending member 60 is in the same plane and flush with the upper surface of secondary deck 50. Similarly, with deck extending member 70 in an unfolded position, an inner edge of flange 62*a* engages stop 52*a* to prevent further rotation of deck extending member so that the upper surface of the deck extending member 70 is in the same plane and flush with the upper surface of secondary deck 50.

When secondary deck 50 is deployed, it may be desirable to include tubes or tanks to provide for a buoyant upward force to act as a counter force to the weight of the passengers on the deck. Thus, for example, tubes (such as PVC tubes) filled with air could extend through holes 55 in transverse members 51*a*-51*c* to provide such a buoyant force. In some embodiments the tubes could be capped, such that they are always filled with air, whereas in other embodiments, they could be connected to a supply of air, and the amount or within the tubes could be controlled to provide a desired level of buoyancy depending on the conditions.

Figure 7:
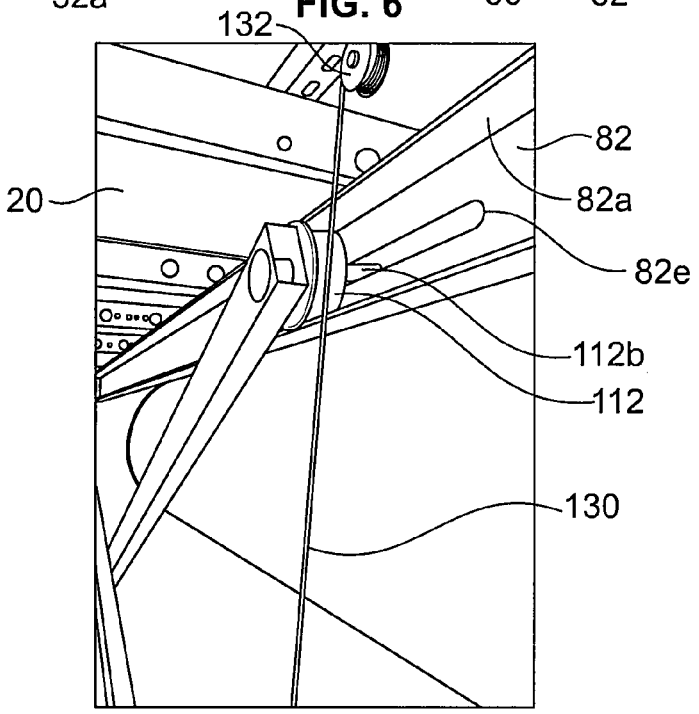
FIG. 7 is a perspective close up view from the underneath of pontoon 10 shown in FIGS. 1-5, showing roller 112 within track 82*a* of upper frame member 82.

FIG. 7 is a perspective close up view from the underneath of pontoon 10 shown in FIGS. 1-5, showing roller 112 within track 82*a* of upper frame member 82. Upper frame member has a C-shape cross section 82*a* with roller 112 positioned therein. A slot 82*e* is positioned in upper frame member 82 that allows for rolling movement of roller 112 having a portion 112*b* that extends through the slot 82*e*. Cable 130 is shown positioned over pulley 132.

In a preferred embodiment, the upper and lower frame members, scissors mechanism arms, secondary deck, and deck extending members are made of aluminum. Upper frame member 82 may have C-shaped cross section that has a height of 6 inches, and may be 11 feet 8 inches long. Slot 82 may have a height of 1.25 inches and be 15 inches long. The first and second arms of the scissors mechanism may be 10 feet, 4 four inches in length and be pivotally connected using a solid aluminum member having a circular diameter of 2 inches. Rollers 112 and 112*a* may be solid aluminum with a diameter of 5.25 inches to fit with the C-shaped cross section of the upper frame members. The rollers such as roller 112 and 114 may advantageously be made of polyester nylon. The upper surfaces of the secondary deck and deck extending members can be provided with a flooring surface made of wood, plastic, fiberglass, or other material capable of providing a flooring surface for the passengers on the boat.

Figure 8A:
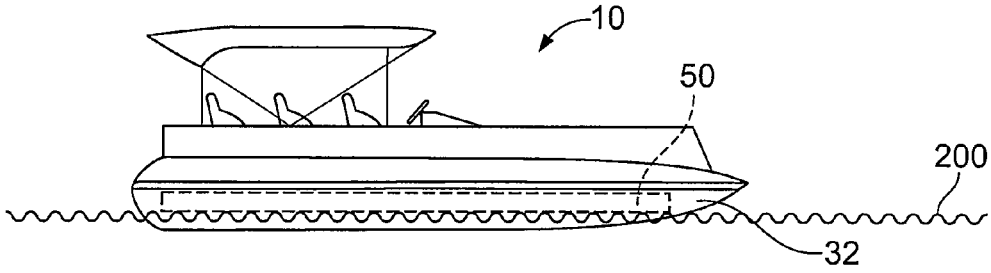
FIG. 8A is a side view of the pontoon boat 10 shown in FIGS. 1-7 with secondary deck 50 in a first stowed position; according to an example embodiment.

FIG. 8A is a side view of the pontoon boat 10 shown in FIGS. 1-7 with secondary deck 50 in a first stowed position; according to an example embodiment. In this configuration, pontoon boat 10 may be operated for movement over the water surface 200, or also be stored on a trailer, as secondary deck 50 is positioned underneath the main deck of the pontoon boat 10. The positioning of secondary deck 50 with respect to pontoon 32 is illustrative only, and in this example, secondary deck 50 is shown slightly above the water surface 200, although in other embodiments the secondary deck 50 may be even with or positioned below the water surface 200 when in the stowed positioned.

Figure 8B:
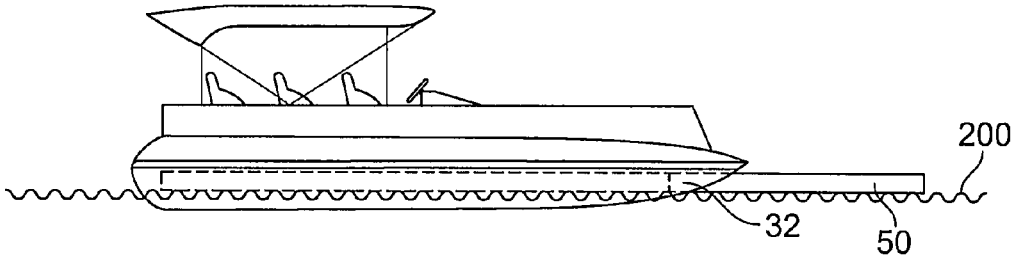
FIG. 8B is a side view of the pontoon boat 10 shown in FIG. 8A with secondary deck 50 moved into a second extended position.

FIG. 8B is a side view of the pontoon boat 10 shown in FIG. 8A with secondary deck 50 moved into a second extended position, just above the waterline, although in other embodiments it may be even with or positioned below the waterline.

Figure 8C:
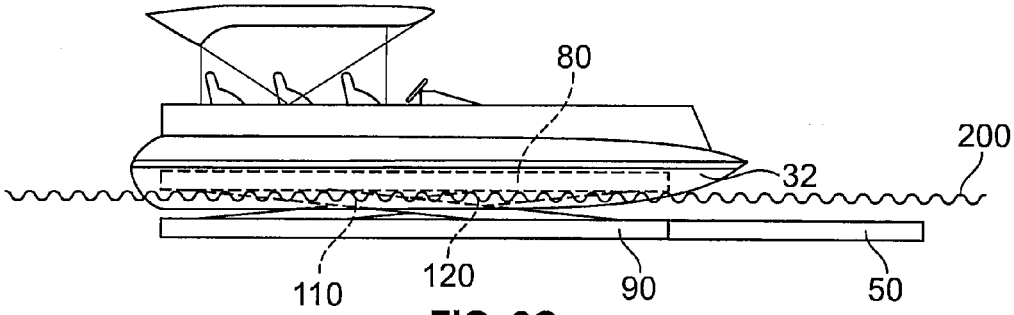
FIG. 8C is a side view of the pontoon boat 10 shown in FIGS. 8A and 8B with secondary deck 50 lowered into a third submerged position, where secondary deck 50 provides an underwater platform.

FIG. 8C is a side view of the pontoon boat 10 shown in FIGS. 8A and 8B with secondary deck 50 and lower frame 90 lowered into a third submerged position via operation of scissors mechanism arms 110 and 120 beneath upper frame 80, where secondary deck 50 provides an underwater platform. In this configuration, passengers on the pontoon boat may stand on the underwater platform or sit in chairs on the platform.

Figure 8D:
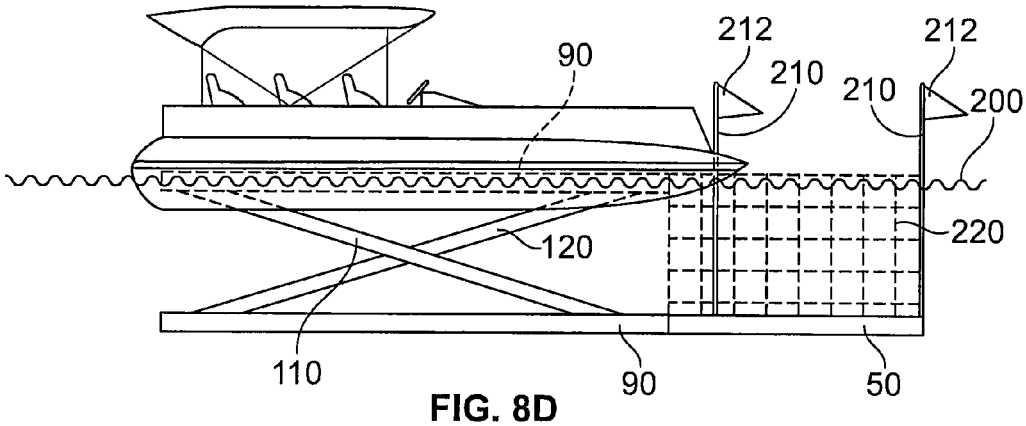
FIG. 8D is a side view of the pontoon boat 10 shown in FIGS. 8A-8C with secondary deck 50 further lowered into a submerged position and having an area above secondary deck 50 enclosed by a fence 220; according to an example embodiment.

FIG. 8D is a side view of the pontoon boat 10 shown in FIGS. 8A-8C with secondary deck 50 further lowered into a submerged position via operation of scissors mechanism arms 110 and 120, and having an area above secondary deck 50 enclosed by a fence 220. In this configuration, an enclosed swimming area with the secondary deck 4-5 feet beneath the water surface 200 is provided. The fence 220 could be made of netting or rope or other material suitable to prevent persons or pets from escaping the enclosed area. Upwardly extending safety indicia 210, which may include flags 210 or lights, may be used to demarcate the edges of the secondary deck 50 beneath the water surface.

The configurations set forth in FIGS. 8A-8D illustrate a method of providing an underwater platform on a multi-hull vessel including the steps of: (1) providing a vessel having a main deck, a first hull and a second hull positioned beneath the main deck, an upper frame positioned beneath the main deck, a lower frame attached to the upper frame, a secondary deck movably mounted to the lower frame in a first stowed position beneath the main deck of the vessel between the first hull and the second hull, (2) extending the secondary deck from the first stowed position into a second extended position in front of the main deck, and (3) lowering the secondary deck into a third submerged position under the water to provide an underwater platform.

It will be appreciated that steps (2) and (3) are not required to be performed in this order. Thus, the secondary deck 50 may first be lowered into a submerged position, and then extended into the extended position, or the secondary deck 50 may be lowered and extended at the same time. Thus, unless specifically stated in the claims, the steps (2) and (3) may be performed in any order or simultaneously.

The method may further include the step of unfolding one or more deck extenders from the secondary deck to increase the size of the secondary deck.

Example embodiments have been described above. Those skilled in the art will understand that changes and modifications may be made to the described embodiments without departing from the true scope and spirit of the present invention, which is defined by the claims.

I claim:

1. A multi-hull vessel comprising:

a main deck;

a first hull and a second hull positioned beneath the main deck;

a secondary deck;

wherein the secondary deck is extendable from a first stowed position beneath a main deck of the vessel between the first hull and the second hull to a second extended position in front of the vessel; and wherein the secondary deck is further movable to a third submerged position where the secondary deck provides an underwater platform.

2. The multi-hull vessel of claim 1, further comprising:

an upper frame attached to a bottom of the main deck;

a lower frame connected to the upper frame and positioned below the upper frame;

wherein the lower frame is lowered beneath the upper frame when the secondary deck is in the third submerged position.

3. The multi-hull vessel of claim 2, wherein the secondary deck is extendable from the lower frame to the second extended position.

4. The multi-hull vessel of claim 3, wherein the secondary deck is retractable within the lower frame.

5. The multi-hull vessel of claim 2, wherein the upper frame is connected to the lower frame with a pair of scissor devices configured to raise and lower the lower frame relative to the upper frame.

6. The multi-hull vessel of claim 5, wherein the scissor devices each include a first arm having a first end rotatably secured to the upper frame and a second end adapted for rolling engagement with the lower frame, and second arm having a first end rotatably secured to the lower frame and a second end secured adapted for rolling engagement with the upper frame.

7. The multi-hull vessel of claim 6, wherein the first arm is rotatably coupled to the second arm at a mid-section of the first and section arms.

8. The multi-hull vessel of claim 6, where the second end of the first arm includes a roller positioned within a longitudinal positioned first member attached to the upper frame that has a C-shaped cross section, and the second end of the second arm includes a roller positioned within a longitudinally positioned second member attached to the upper frame.

9. The multi-hull vessel of claim 2, including means for extending the secondary deck from the lower frame to the second extended position.

10. The multi-hull vessel of claim 2, wherein a cylinder has a body secured to the lower frame and a piston rod secured to the secondary deck, wherein extension of the piston rod from the body caused the secondary deck to move into the second extended position.

11. The multi-hull vessel of claim 1, further including a first deck extending member rotatably connected to the secondary deck, wherein the first deck extending member is positionable in a first stowed position where the first deck extending member is folded against the secondary deck and also positionable in a second extended position where the first deck extending member is rotatably unfolded to extend from the secondary deck to provide a first deck extension to the secondary deck.

12. The multi-hull vessel of claim 11, further including a second deck extending member rotatably connected to the secondary deck, wherein the second deck extending member is positionable in a first stowed position where the second deck extending member is folded against the secondary deck and also positionable in a second extended position where the second deck extending member is rotatably unfolded to extend from the secondary deck to provide a second deck extension to the secondary deck.

13. The multi-hull vessel of claim 11, wherein a flange is mounted transversely on an outer end of the first deck extending member and a stop is mounted to an outer end of the secondary deck, wherein when the first deck extending member is unfolded to the second extended position, a side of the flange engages the stop member to prevent further rotation of a forward end of the first deck extending member.

14. The multi-hull vessel of claim 2, wherein one or more tubes or tanks are secured to one of the lower frame and the secondary deck and wherein the one or more tubes or tanks are fillable with water to provide a downward force when the secondary deck is lowered, and are fillable with air to provide a buoyant upward force when the secondary deck is raised or deployed.

15. The multi-hull vessel of claim 14, wherein a flange is mounted transversely on an outer end of the second deck extending member and a stop is mounted to an outer end of the secondary deck, wherein when the second deck extending member is unfolded to the second extended position, a side of the flange engages the stop member to prevent further rotation of a forward end of the second deck extending member, and wherein when the second deck extending member is unfolded to the second extended position, an inner edge of the second deck extending member engages the lower frame to prevent further rotation of a rear end of the second deck extending member.

16. The multi-hull vessel of claim 1, further including members that upwardly extend from the underwater platform when the secondary deck is in the third submerged position, to a position above a waterline to mark the boundaries of the underwater platform.

17. The multi-hull vessel of claim 1, further including a fence positioned around a perimeter of the secondary deck to provide an enclosed swimming area when the secondary deck is in the third submerged position.

18. The multi-hull vessel of claim 1, wherein the third submerged position has a variable depth below the water.

19. The multi-hull vessel of claim 18, wherein the third submerged position is 1-5 feet below the water.

20. The multi-hull vessel of claim 18, wherein the third submerged position is 4-5 feet below the water.

21. A pontoon boat comprising:

a main deck;

a first pontoon and a second pontoon positioned beneath the main deck;

an upper frame attached to a bottom of the main deck between the first pontoon and the second pontoon;

a lower frame connected to the upper frame and positioned below the upper frame;

a secondary deck movably engaged with the lower frame;

wherein the secondary deck is extendable from a first stowed position beneath the main deck of the vessel to a second extended position in front of the vessel; and wherein the secondary deck is further movable to a third submerged position where the secondary deck provides an underwater platform.

22. The pontoon boat of claim 21, wherein the upper frame is connected to the lower frame with a pair of scissor devices configured to raise and lower the lower frame relative to the upper frame, wherein the scissor devices each include a first arm having a first end rotatably secured to the upper frame and a second end adapted for rolling engagement with the lower frame, and second arm having a first end rotatably secured to the lower frame and a second end secured adapted for rolling engagement with the upper frame, and wherein the first arm is rotatably coupled to the second arm at a mid-section of the first and section arms.

23. The pontoon boat of claim 22, where the second end of the first arm includes a roller positioned within a longitudinal positioned first member attached to the upper frame that has a C-shaped cross section, and the second end of the second arm includes a roller positioned within a longitudinally positioned second member attached to the upper frame.

24. The pontoon boat of claim 21, including means for extending the secondary deck from the lower frame to the second extended position.

25. The pontoon boat of claim 1, further including a first deck extending member rotatably connected to the secondary deck, wherein the first deck extending member is positionable in a first stowed position where the first deck extending member is folded against the secondary deck and also positionable in a second extended position where the first deck extending member is rotatably unfolded to extend from the secondary deck to provide a first deck extension to the secondary deck.

26. The pontoon boat of claim 25, wherein a flange is mounted transversely on an outer end of the first deck extending member and a stop is mounted to an outer end of the secondary deck, wherein when the first deck extending member is unfolded to the second extended position, a side of the flange engages the stop member to prevent further rotation of a forward end of the first deck extending member.

27. The pontoon boat of claim 22, further including members that upwardly extend from the underwater platform when the secondary deck is in the third submerged position, to a position above a waterline to mark the boundaries of the underwater platform, and further including a fence positioned around a perimeter of the secondary deck to provide an enclosed swimming area when the secondary deck is in the third submerged position.

28. The multi-hull vessel of claim 1, wherein the third submerged position has a variable depth below the water of up to five below the water.

29. A method of providing an underwater platform on a multi-hull vessel comprising the steps of:

providing vessel having a main deck, a first hull and a second hull positioned beneath the main deck, an upper frame positioned beneath the main deck, a lower frame attached to the upper frame, a secondary deck movably mounted to the lower frame in a first stowed position beneath the main deck of the vessel between the first hull and the second hull;

extending the secondary deck from the first stowed position into a second extended position in front of the main deck; and lowering the secondary deck into a third submerged position under the water to provide an underwater platform.

30. The method of claim 29, further comprising the step of:

unfolding one or more deck extenders from the secondary deck to increase the size of the secondary deck.

* * * * *